United States Patent [19]

Huang

[11] Patent Number: 4,946,415

[45] Date of Patent: Aug. 7, 1990

[54] REMOTE CONTROL MYLAR TOY AIRCRAFT

[76] Inventor: San Y. Huang, 2, Lane 164, Pai-Lin 5th Road, Pei-Tou, Taipei, Taiwan

[21] Appl. No.: 302,441

[22] Filed: Jan. 26, 1989

[51] Int. Cl.[5] ..... A63H 27/10

[52] U.S. Cl. ..... 446/225

[58] Field of Search ..... 446/225, 220; 244/30

[56] References Cited

U.S. PATENT DOCUMENTS

| | | | |
|---|---|---|---|
| 3,591,975 | 7/1971 | Terc | 446/225 |
| 4,038,777 | 8/1977 | Schwartz | 446/225 |
| 4,729,750 | 3/1988 | Prusman | 446/225 |
| 4,799,914 | 1/1989 | Hutchinson | 446/225 |

*Primary Examiner*—Mickey Yu

*Attorney, Agent, or Firm*—Bucknam and Archer

[57] ABSTRACT

The present invention relates to a remote control mylar toy aircraft and, more particularly to an inflatable mylar toy aircrat includes a remote receiver to control two motors, fitted with balance weights and a suspending balance strip. After having been inflated, the mylar toy aircraft is remote controlled to fly forward or backward, or to turn aside, or to move upward or downward. When the mylar toy aircraft stands still in the air at a certain height from the ground, it is controlled by the balance strip to prevent it from dropping to the ground or flying away. By means of relatively rise and fall adjustment between the balance weights and the balance strip, the flying height of the mylar toy aircraft is properly adjusted.

1 Claim, 2 Drawing Sheets

REMOTE CONTROL MYLAR TOY AIRCRAFT

BACKGROUND OF THE INVENTION

Flying in the air has been a dream of human beings for a very long time. In order to make the dream come true, people keep researching and studying this matter. Therefore, this motive has become a power to promote the development of aviation industry.

With respect to toys, there are diversified toy cars and toy aircraft available to satisfy children's demand. In recent years, following the development in material science and electronic technology, remote control toys have become one of the main streams in toy industry.

Regular remote control mylar toy aircraft normally comprises a container at the bottom of the body for setting therein of battery and remote receiver, and is equipped with balance weights to let the total weight become slightly heavier than the buoyancy resulting from the inflation of helium such that the inflated toy aircraft is kept to stay on the ground and prevented from flying away.

The conventional remote control mylar toy aircraft are of two types. The first type is the toy aircraft which includes a servomotor and a gear set to control the axial position of propellers and to turn the two bilateral propellers downward to a vertical position so as to produce a floating force to keep the toy aircraft float upward to a preferred height. By means of the same servomotor and gear set to adjust the angular position of the propellers, the toy aircraft is driven to move forward, backward or to turn aside. At the same time, the propelling power produced by the propellers partly contributes to keep the toy aircraft to float in the air.

Another type is the toy aircraft which, in addition to the two bilateral propellers, includes an additional downward disposed vertical propeller. When this vertical propeller is initiated, the toy aircraft will float upward. As soon as the toy aircraft moves upward to a preferred height, the horizontal propellers are turned on to control forward and backward floating of the toy aircraft. During operation, the vertical propeller should be unceasingly switching on/off to control the floating of the toy aircraft at a certain level of height.

The above-described two structures have some drawbacks. The servomotor and gear set or the vertical propeller increase the size and weight of the toy aircraft and its manufacturing cost, complicates the operation, and makes it not possible of fly in sitting room.

The present invention provides a kind of remote control mylar toy aircraft having numerous features each of which tends to make the structure more practical and compact, easy to operate, and inexpensive to manufacture.

The present invention will be more apparent from the following description quoted on the basis of the annexed drawings.

DETAILED DESCRIPTION OF THE PREFERRED EMBODIMENT

Figure 2:
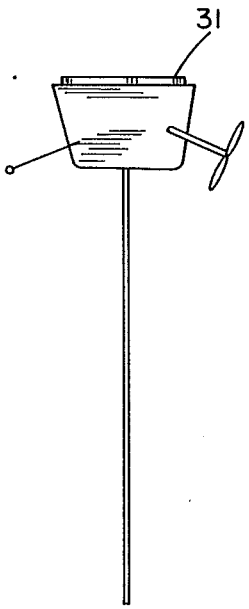
FIG. 2 is a schematic drawing of the receiver box and the balance strip.
Figure 1B:
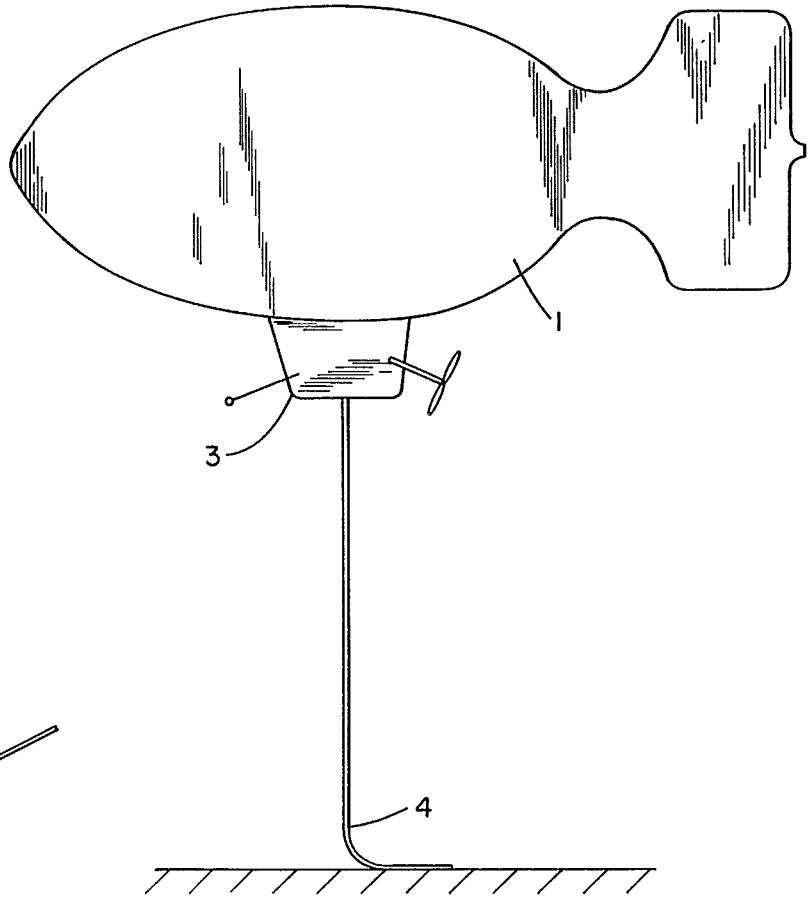
FIG. 1 is a schematic drawing of a preferred embodiment of the present invention.
Figure 1A:
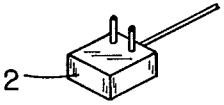
Figure 3:
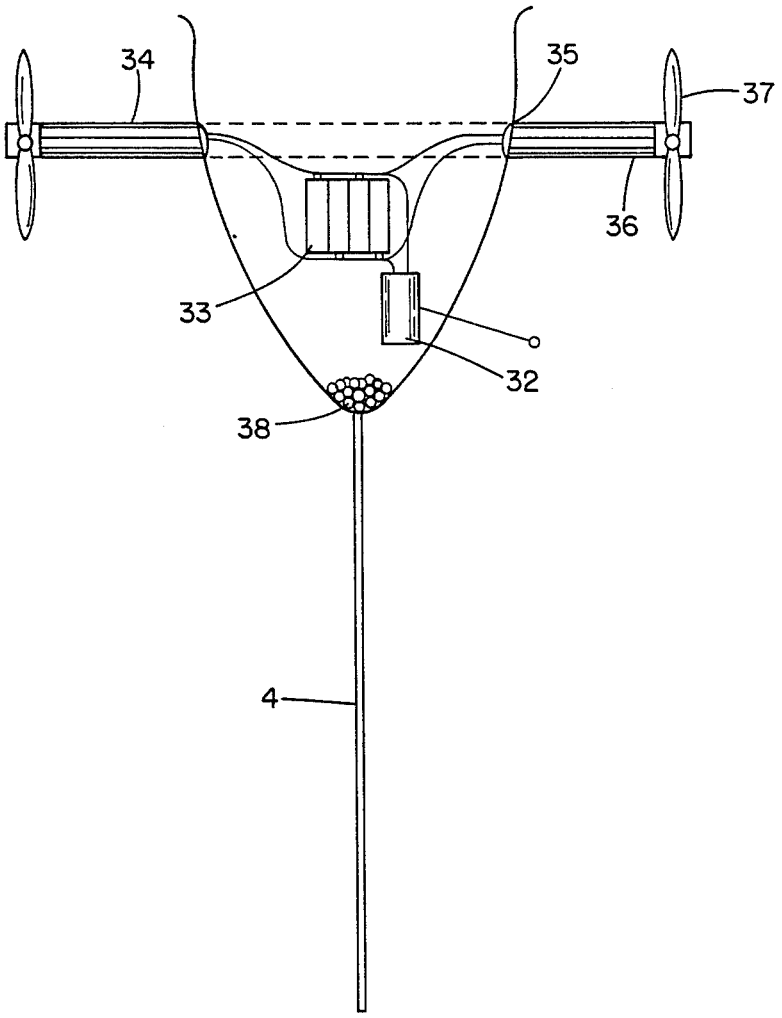
FIG. 3 is a schematic sectional view of the receiver box.

Referring to FIGS. 1 through 3, a toy aircraft includes a body (1), a transmitter (2), a receiver box (3), and a balance strip (4).

The said body (1) is an inflatable sack, preferably made of mylar. The gas used to inflate said body (1) is preferably the helium or hydrogen which is light than air.

The said transmitter (2) is a conventional device comprising a transmitting means, and a forward, backward, and direction-turning control keyboard, for operation to transmit a signal to said receiver box so as to control the driving power.

The said receiver box (3) is attached to said body (1) at the gravity center by means of respective fastening means, for example, velcro (31), so as to let the connection be convenient to detach. The said receiver box (3) comprises in the interior a remote control receiver (32) fitted with an receiving antenna, and a battery (33). A motor tube (34) is provided to pass through two sleeves (35) which are disposed at both sides of said receiver box (3). Two motors (36) are respectively set in said motor tube (34) at both ends. The said two motors (36) each comprises a revolving shaft protruding beyond said motor tube (34) for connection thereto with a respective propeller (37). Several balance weights (38) are set in said receiver box (3) to match with the floatage of said body (1) so as to prevent said body (1) from flying away to get rid of control.

Because the said propeller (37) is controlled by means of said remote control receiver (32) and said transmitter (2) to make forward or backward rotation or to stop, the air craft is controlled to move forward or backward or to turn a direction accordingly.

The said balance strip (4) is suspended from the gravity center of said body (1), that is, the bottom of said receiver box (3), and is made of several units of strips by means of series connection, to allow adjustment of its length. The total weight of said balance strip (4), said receiver box (3) and said body (1) is slightly heavier than the floatage so as to allow a small section of the rear end of said balance strip (4) to be in contact with the ground, and to allow said body (1) to be stably floating in the air at a certain height to prevent the aircraft from breaking away or dropping to the ground. The length of said balance strip (4) may be adjusted according to preferred height. When the length of said balance strip (4) is extended, the amount of said balance weights (38) shall be reduced or if the length of said balance strip (4) is reduced, the amount of said balance weights (38) shall be increased accordingly.

Therefore, during application, the matching of the balance weights with the balance strip may be flexibly adjusted according to player's age. According to this arrangement, the toy aircraft of the present invention does not need the propeller which provides an upward propelling power. While stop flying at a certain height, the toy aircraft of the present invention is controlled by means of the balance weights and balance strip to stably keep standing still in the air and the air craft will neither break away from the control nor drop to the ground to damage the structure.

As indicated, the structure herein may be various embodied. Recognizing various modifications will be apparent, the scope hereof shall be deemed to be defined by the claim as set forth below.

I claim:

1. A remotely controllable toy aircraft, consisting of in combination, a body made of light material and being inflatable by a gas lighter than air, said body having a center of gravity, a receiver box detachably connected to said body whereby the weight of said body, said receiver box acts on the center of gravity of said body, said receiver box including in the interior thereof a remotely controllable receiver fitted with a receiving antenna and several units of balance weights, said receiver box comprising a motor tube, two battery powered motors each of which is located at one end of said motor tube, each of said motors being located at each end of said receiver box, said motors being controlled by said receiver and two propellers each of which is connected to each of said motors, a length-adjustable balance strip made of several units of strips in series connection, said balance strip being suspended from the bottom of said receiver box, said balance weights being located above said balance strip, a transmitter spaced from said receiver box, including transmitting means and a control keyboard, for transmitting a signal to said receiving box initiated by said control keyboard, said toy aircraft less said balance weights having a certain upwardly directed pull of floatability, the total weight of said body, said receiver box, said balance weights and said balance strip being greater than said floatability whereby a small segment of the rear portion of said balance strip is in contact with the ground to facilitate controlling the floating height of said toy aircraft, the floating height of said toy aircraft being adjustable by increasing the units of said balance weights and reducing the length of said balance strip, or by increasing the length of said balance strip and reducing the units of said balance weights.

* * * * *